United States Patent [19]

Phelps

[11] 4,068,506

[45] Jan. 17, 1978

[54] HIDDEN LOCK

[76] Inventor: Robert A. Phelps, 220 Granlan Road, Baltimore, Md. 21228

[21] Appl. No.: 739,036

[22] Filed: Nov. 5, 1976

[51] Int. Cl.[2] ..... E05B 65/08; E05C 19/18

[52] U.S. Cl. ..... 70/100; 70/403; 292/138; 292/244; 292/288; 292/DIG. 46

[58] Field of Search ..... 70/89, 90, 95, 100, 70/403, 404, 462, DIG. 80; 292/137, 138, 145, 164, 174, 244, 251, 288, DIG. 46, DIG. 47; 29/280; 85/42

[56] References Cited

U.S. PATENT DOCUMENTS

| | | | |
|---|---|---|---|
| 1,050,692 | 1/1913 | Resch | 70/100 |
| 1,461,554 | 7/1923 | Raffay | 29/280 |
| 1,580,611 | 4/1926 | Kirkpatrick | 70/90 |
| 1,632,482 | 6/1927 | Kroells | 29/280 X |
| 1,897,196 | 2/1933 | Hunt | 85/42 |
| 2,098,048 | 11/1937 | Kistner | 70/90 |
| 2,120,788 | 6/1938 | Riccelli | 70/90 X |
| 2,537,049 | 1/1951 | Glatt | 292/145 |
| 3,288,510 | 11/1966 | Gough et al. | 70/90 X |
| 3,642,315 | 2/1972 | Alpern | 292/144 |

FOREIGN PATENT DOCUMENTS

| | | | |
|---|---|---|---|
| 6,642 of | 1913 | United Kingdom | 70/90 |

*Primary Examiner*—Roy D. Frazier
*Assistant Examiner*—Thomas J. Holko
*Attorney, Agent, or Firm*—Alfred B. Levine

[57] ABSTRACT

A hidden or concealed lock for sliding windows, door panels and the like, employing a concealed hollow tubular locking sleeve that is positioned entirely inside of an aligned opening passing through the interior frame of one of said windows and into the frame of the other window. The locking sleeve is manipulated into and out of locking position by a small rod shaped key member that is coaxially insertable into the locking sleeve from outside the window after passing through the small opening in the window frame. Both the locking and key members and openings are made small and unobstrusive; and are located for concealment in differing locations. These features prevent an unauthorized user from either locating the lock, determining its mode of operation; or unlocking the windows or panels without access to the special key.

4 Claims, 2 Drawing Figures

HIDDEN LOCK

BACKGROUND AND PROBLEM OF THE PRIOR ART

This invention generally relates to security locks for windows, doors, and panels; and more particularly to concealed or hidden locks that are particularly adapted for use with sliding closures.

In the customary locking means employed for use with sliding sash windows, sliding door panels, and like enclosures, the operating parts of the locking means are usually located in the same position on the doors and windows, such as on the inside window panel, generally projecting above the upper portion of the window frame. These locking parts can be easily seen through the transparent window panes and are also easily located by touch in the dark. An intruder on the outside may therefore easily open a window by breaking a conveniently located window pane and manually disengage the interlocking members, or may easily break the lock using any one of a variety of tools including a simple screwdriver or pry bar.

In a similar manner, the customary locks for sliding doors or panels are generally located in the same relative positions on the doors, with the interengaging parts being clearly visible and therefore easily found by sight or touch. An unauthorized person can therefore quickly locate and then break or open the lock to gain acess to the enclosed area.

More elaborate and specially constructed locks and latches for sliding windows or panels are, of course, obtainable and may be custom fabricated to provide a greater degree of security. However, such special locking devices are much more costly and therefore unsuitable for common everyday uses on sliding sash windows, sliding doors, and panels.

SUMMARY OF THE INVENTION

According to the present invention, there is provided a concealed locking means for such applications, that is both inexpensive and neither visible nor readily detectable by touch. Additionally, its construction, and mode-of-operation is such that it may be easily installed in different unusual locations on sliding windows and/or doors to provide an additional measure of security, thereby to further impede unauthorized access or entry into the locked region by an intruder seeking to disengage or break the lock.

Briefly according to a preferred embodiment, a pair of relatively sliding windows or panels are provided with small aligned tubular openings transversely passing through the cross section of one panel or frame and extending into the interior of the second panel or frame when the two windows or panels are relatively disposed in their closed position. For locking the panels together, a small hollow locking sleeve is positioned entirely within said aligned openings by a suitable key or tool. A portion of the locking sleeve is disposed within the opening in one frame or panel and the remaining portion is disposed entirely inside the aligned opening in the second panel or frame.

Accordingly, an unauthorized intruder has difficulty in locating the position or location of the hidden or concealed locking sleeve since the only visible or detectable portion is a small hole or opening leading from the outer surface of the outside panel or window frame. Secondly, an unauthorized intruder has difficulty in removing the locking sleeve from its concealed position inside of the aligned openings without access to the special key or tool necessary for such purpose. Additionally, such an intruder encounters a still further difficulty in determining the mode-of-operation of this concealed lock, as well as gaining access to the hidden sleeve without the special tool as discussed above.

DETAILED DESCRIPTION OF PREFERRED EMBODIMENTS

Figure 1:
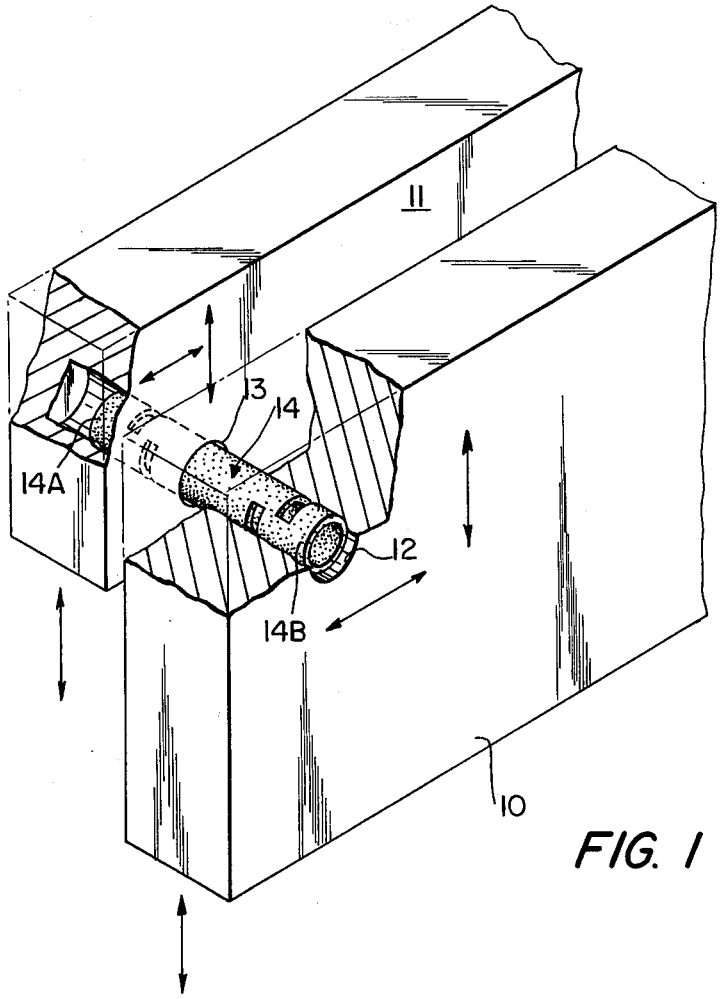
FIG. 1 is an enlarged perspective view, partly in section, illustrating a preferred embodiment of the locking sleeve in place between two slidable windows or panels.

In the embodiment of FIG. 1, there is shown a pair of panels 10, and 11, that may be windows or doors, that are suitably supported in frames (not shown) to slide with respect to one another in either one of the horizontal or vertical directions, as is generally illustrated by the arrowed lines. As will be appreciated, these illustrated portions of panels 10 and 11 may be the top or side frames of a conventional type of wooden sash window, or may be merely the overlapping portions of slidable door panels used as closures for rooms or closets; or as slidable doors for cabinet closures, or as the slidable panel portions of cabinet drawers or the like.

In the outer panel 10 there is provided a small tubular opening 12 passing transversely throughout the entire cross section of this panel and facing an aligned tubular opening 13 that is provided only partway into the interior of the second panel 11, as shown. For better illustrating this construction in the drawings, it is noted that the upper left hand portion of panel 10 is shown in cutaway section so that only the base half, or hemitube, of the opening 12 passing through panel 10 is illustrated.

For detachably locking the two panels 10 and 11 together according to the invention, a hollow, cylindrically shaped locking sleeve 14 of metal is inserted into the aligned tubular openings 12 and 13, with the forward portion 14A of sleeve 14 extending into the opening 13 in panel 11, and the rear portion 14B thereof being disposed entirely inside of the opening 12 in panel 12, whereby the locking sleeve 14 is entirely concealed inside the aligned openings 12 and 13 and is neither visible or detectable by sense of touch from the outside of either panel. With this construction, it will be observed that the two panels are locked together and prevented from any relative sliding movement along their guideways (not shown) by the presence of the locking sleeve 14 disposed as a barrier in the aligned openings in the two panels 10 and 11.

As will be appreciated by those skilled in the art, the hollow tubular locking sleeve 14 may be made quite small, in diameter to concealably fit into very small aligned tubular openings 12 and 13 in the panels 10 and 11, yet when made of suitable metals may provide a quite effective lock that is not easily broken or deformed, to permit the panels to be slidably opened. The locking sleeve 14 is preferably made of sufficient length with respect to the thickness of the panels, to be manually handled and inserted into and removed from the aligned openings by a special key or tool, to be described below; yet of insufficient length to project outside of the opening 12 in outer panel 10 when it is fully inserted; or to be easily seen or detected from the outside of the panel 10. For a typical sliding sash window made of wood, the tubular locking sleeve 14 may be made up to one inch and one half or more in length, and at least one eighth inch or more in outer diameter.

Figure 2:
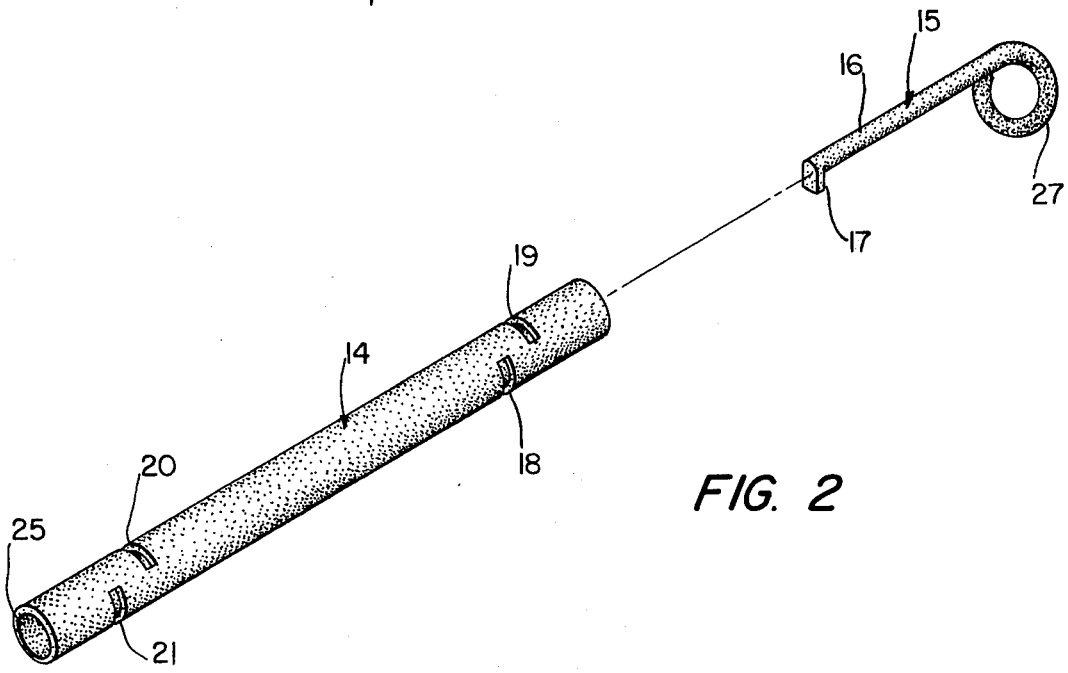
FIG. 2 is an enlarged perspective view illustrating a preferred construction for the locking sleeve and positioning key.

FIG. 2 illustrates the preferred construction of the locking sleeve 14 and of the special key or tool 15 for manually positioning the sleeve 14 into and out of its concealed locking position in the aligned openings 12 and 13 in the panels. As shown, the locking sleeve 14 is provided with pairs of semi-circular slots near opposite ends for the purpose of enabling the sleeve 14 to be easily inserted and removed from its concealed opening by the special key 15. More specifically, near one end there is provided a semi-circular circumferential slot 18 passing about the lower half of the sleeve and a slot 19 about the upper half and axially displaced from the lower slot. In a similar manner, the displaced circumferential semi-circular slots 20 and 21 are provided in the sleeve near the opposite end, thereby enabling either one of the ends of the sleeve 14 to be inserted into the panel openings 12, 13.

For inserting the sleeve 14 into the panel openings 12, 13, it is easily positioned into the openings by hand and inserted into the interior by a light finger movement or tapping against its free end. The key 15 is then inserted into the sleeve 14 and employed to position the sleeve 14 further into the panel openings 12, 13 to its concealed position, as illustrated in FIG. 1. This special key 15 is preferably constructed of a small metal rod or wire of circular cross section having a straight central shank section of smaller diameter than the central opening 25 in the locking sleeve 14, for permitting coaxial insertion of the key 15 into the sleeve 14. At one end, the key 15 is provided with a small projection 17, and at the other end the wire key 15 is bent into an eyelet or loop 27 for convenience to the user in holding the key, and for permitting the key 15 to be unobtrusively suspended from a small nail or the like nearby the window or panel that is adapted to be locked. The length of the projection 17 on the key 15 is also made smaller than the diameter of the opening 25 of sleeve 14 so that the key 15 can be easily inserted inside of the sleeve 14 and then gently lowered (or raised) to enable the small projection 17 to selectively pass into one or the other of slots 18 and 19. Upon the members being interengaged in this manner, axial movement of the key 15 toward the panel holes 12, 13 pushes the sleeve 14 further into concealed position within the panel openings. Conversely, withdrawing the key 15 while its projection 17 is engaged with the walls of the slot withdraws the end of sleeve 14 from its opening in the panel, enabling the entire sleeve 14 to be completely withdrawn to unlock the panels.

The above described construction of the sleeve 14 and special key 15 is preferred as being inexpensive and simple to fabricate. The provision of pairs of slots at opposite ends, enables either end of the sleeve 14 to be inserted into the closed panels since the key 15 may engage the slots at either opposite end. For similar reasons, pairs of slots are provided so that the key 15 may be inserted into the sleeve 14 with its projection 17 facing either downwardly or upwardly. If the former, the key projection 17 would interengage with lower slot 19; and if the latter, it would interengage with upper slot 18. Since the locking sleeve 14 is adapted to be disposed in a concealed location inside of the aligned openings in panels 10 and 11, this preferred construction insures that the user has no difficulty in either inserting or removing the sleeve 14 into and out of its locking position; and even when performing these functions in the dark or under conditions of poor visibility. Once the aligned opening 12 and 13 in the panels are located by sight or touch, the user merely inserts the sleeve 14 into the openings, either end first, and then inserts the key 15 into the sleeve. By sense of feel, the user then interengages the key projection 17 into one of the slots of the sleeve 14. Since the pair of opposed slots encompasses the entire circumference of the sleeve 14, it is not necessary for the user to know the angular direction of the projection 17 of key 15 in order to engage one of the slots.

As will now be apparent, many changes may be made in the construction of the locking sleeve 14 and of the special key 15 without departing from the spirit and scope of this invention. For example, the sleeve may be constructed of a hollow tube of rectangular configuration or other uniform or non-uniform cross section; of suitable non-metal materials; and of varying other lengths, sizes, and configurations. Similarly, the special key 15 may be formed with an L-shaped projection, as shown, or with a circular projection, or other projection or catch to suitable interengage with slots or openings in the sleeve. In each instance, however, it is preferred that the sleeve be manipulated when either end is inserted into the panel, and that the key likewise be constructed in such manner as to be insertable into the opening at any angular position and easily interengage with the sleeve at any angular position. It will also be apparent that more than one such locking means may be provided for each pair of panels if greater security is desired. Since these and other changes may be made, this invention is to be considered as being limited only by the following claims.

What is claimed is:

1. A concealed lock for panels such as windows and doors that have adjoining portions when the panels are in closed position, and when closed having an aligned opening extending from one panel to the other, comprising:

a symmetrically formed hollow sleeve member slidably insertable without rotation and removable from said aligned opening, either end first, with the entire sleeve being concealed inside the aligned opening, a key member insertable into said concealed hollow sleeve and easily and quickly interengageable and disengageable with the sleeve at the closest end to remove the sleeve member and unlock the panels, said hollow sleeve member having engageable means near each opposite end, and said key having coacting means for easily engaging said sleeve member at either end when inserted into the concealed sleeve, despite the angular orientation of the key with respect to the sleeve.

2. A concealed lock for panels such as windows and doors that have adjoining portions when the panels are in closed position, and when closed having an aligned opening extending from one panel to the other, comprising:

a symmetrically formed hollow sleeve member slidably insertable without rotation and removable from said aligned opening, either end first, with the entire sleeve being concealed inside the aligned opening, a key member insertable into said concealed hollow sleeve and easily and quickly interengageable and disengageable with the sleeve at the closest end to remove the sleeve member and unlock the panels, said hollow sleeve member having a circumferentially disposed slot near each opposite end, and said key having means for easily engaging the slot at either end when inserted into the concealed sleeve, despite the angular orientation of the key with respect to the sleeve.

3. A hidden locking means for locking and unlocking two relatively slidable panel members disposed for relative movement in adjacent planes, including window panels, door panels, and the like; and wherein said relatively slidable panel members are provided with aligned openings therein when said panels are disposed in locking position, with the opening through one of said panel members extending completely through its cross section and confronting the opening into the other panel member; the improvement comprising a hollow sleeve locking member having transverse outer dimensions smaller than said aligned openings for non-rotative sliding insertion into the through opening in said one of said panel members and entirely positionable in an axial direction into the interior of said through opening, said locking member having a length sufficient to project out of the opposite side of said through opening of said panel member and into the aligned opening of the other panel member when it is inserted entirely into said through opening, and an associated key member for inserting and removing said locking member from said aligned openings, said key member having transverse dimensions smaller than said hollow sleeve and aligned openings for insertion and removal into and from said sleeve, and said key member and locking member having quickly detachable interengaging means for enabling said key member to engage said sleeve from the inside and to axially position said locking member by sliding movement entirely inside of said aligned openings so as to be inaccessible from the exterior of said members and to thereafter be removed from said aligned opening to provide a concealed and inaccessible locking means for said member, said locking member comprising a unitary hollow sleeve member having an outer diameter that is smaller than the aligned openings in said panel members, and said key member comprising a cylindrical rod insertable into the interior of said sleeve, said sleeve having a circumferentially disposed slotted opening near one of its ends and said key member having a transversely projecting portion that is detachably interengageable into said slotted opening for reciprocally positioning said sleeve when the sleeve is concealed inside the interior of said aligned openings, said sleeve having a second circumferentially disposed slotted opening near the opposite end thereof, whereby either end of said sleeve may be reversibly inserted into said aligned openings and positioned therein by the key member engaging the slot at the opposite end.

4. In the hidden lock of claim 3, said slotted openings being provided partially circumferentially about said sleeve, with a plurality of axially displaced slots at each end to enable engagement of said key with a portion of one of said slots regardless of the rotative position of said sleeve in the aligned openings.

* * * * *